US011653164B1

(12) United States Patent
Devantier

(10) Patent No.: US 11,653,164 B1
(45) Date of Patent: May 16, 2023

(54) AUTOMATIC DELAY SETTINGS FOR LOUDSPEAKERS

(71) Applicant: Samsung Electronics Co., Ltd., Suwon-si (KR)

(72) Inventor: Allan Devantier, Santa Paula, CA (US)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 0 days.

(21) Appl. No.: 17/563,540

(22) Filed: Dec. 28, 2021

(51) Int. Cl.
*H04S 7/00* (2006.01)
*H04R 3/12* (2006.01)

(52) U.S. Cl.
CPC ..... *H04S 7/301* (2013.01); *H04R 3/12* (2013.01); *H04S 7/302* (2013.01)

(58) Field of Classification Search
None
See application file for complete search history.

(56) References Cited

U.S. PATENT DOCUMENTS 7,630,501 B2 * 12/2009 Blank ..... H04S 7/301 381/59
7,636,126 B2 12/2009 Mallinson
9,380,399 B2 6/2016 Noah
9,560,460 B2 1/2017 Chaikin et al.
10,003,903 B2 * 6/2018 Dougherty ..... H04R 5/02
10,048,930 B1 * 8/2018 Vega ..... H04R 27/00
10,284,991 B2 * 5/2019 Dougherty ..... H04S 7/308
10,587,968 B2 * 3/2020 Maeda ..... H04R 29/002
10,805,750 B2 * 10/2020 Audfray ..... H04R 3/12
10,932,079 B2 * 2/2021 Welti ..... H04S 7/303
11,500,611 B2 * 11/2022 Vega-Zayas ..... G06F 3/165
2004/0151476 A1 8/2004 Suzuki
2006/0067535 A1 3/2006 Culbert et al.
2016/0309258 A1 * 10/2016 Hiscock ..... G01S 5/30
2017/0257722 A1 9/2017 Kerdranvat et al.

* cited by examiner

*Primary Examiner* — Paul W Huber
(74) *Attorney, Agent, or Firm* — Sherman IP LLP; Kenneth L. Sherman; Steven Laut

(57) ABSTRACT

One embodiment provides a computer-implemented method that includes receiving a trigger sound from a primary listening location. The trigger sound being received at multiple speakers in a synchronous network at different times. The trigger sound is recognized at the multiple speakers. A respective relative delay is determined based on a time differential function that determines time differences. Sound quality for the multiple speakers is improved based on the respective relative delay for each of the multiple speakers.

20 Claims, 7 Drawing Sheets

600

AUTOMATIC DELAY SETTINGS FOR LOUDSPEAKERS

COPYRIGHT DISCLAIMER

A portion of the disclosure of this patent document may contain material that is subject to copyright protection. The copyright owner has no objection to the facsimile reproduction by anyone of the patent document or the patent disclosure as it appears in the patent and trademark office patent file or records, but otherwise reserves all copyright rights whatsoever.

TECHNICAL FIELD

One or more embodiments relate generally to sound quality for multiple speakers in a listening environment, and in particular, to automatically determining sound delays per speaker in a listening environment for improving sound quality.

BACKGROUND

For the best spatial sound quality, the distance from a listener to all of the loudspeakers in an audio system should be known. Once this is known, each loudspeaker may be delayed by an appropriate amount such that the sound from all of the loudspeakers arrives at the primary listening location at the same time. Conventionally, the delay is commonly determined by having a user measure the distance from each loudspeaker to the primary listening location and entering this distance into the audio device (e.g., home theater receiver, sound bar, television (TV), etc.) using a "Set Up Menu." Many users, however, can not be bothered to properly set up their loudspeakers, while others may make mistakes.

Some customers hire "Home Theater Installers" to set up their audio system. Some of these installers perform acoustic measurements with a microphone(s) at the listening location (s) to "equalize" the loudspeakers. The microphone at the primary listening location may also be used to measure "the time of flight" from each loudspeaker to the primary listening location. And thus the appropriate delays for the loudspeakers can be accurately calculated and set.

Some newer loudspeakers have microphones built into them that can be used to estimate the average response of the loudspeaker in the entire room or over a listening area. These automated systems can then equalize the loudspeaker. These systems have reduced the need for Home Theater Installers to obtain a good quality sound in their listening environment, but these systems cannot easily determine the distance from each loudspeaker to the primary listening location, which is critical for good spatial quality.

SUMMARY

One embodiment provides a computer-implemented method that includes receiving a trigger sound from a primary listening location. The trigger sound being received at multiple speakers in a synchronous network at different times. The trigger sound is recognized at the multiple speakers. A respective relative delay is determined based on a time differential function that determines time differences. Sound quality for the multiple speakers is improved based on the respective relative delay for each of the multiple speakers.

Another embodiment includes a non-transitory processor-readable medium that includes a program that when executed by a processor performs determining sound delays per speaker in a listening environment that includes receiving, by a respective processor coupled to at least one respective microphone, a trigger sound from a primary listening location. The trigger sound being received at multiple speakers in a synchronous network at different times. Each of the respective processors recognizes the trigger sound at the multiple speakers. Each of the respective processors determines a respective relative delay based on a time differential function that determines time differences. Each of the respective processors improves respective sound quality for the multiple speakers based on the respective relative delay for each of the multiple speakers.

Still another embodiment provides an apparatus that includes a memory storing instructions, and at least one processor that executes the instructions including a process that is configured to receive a trigger sound from a primary listening location. The trigger sound being received at multiple speakers in a synchronous network at different times. The trigger sound is recognized at the multiple speakers. A respective relative delay is determined based on a time differential function that determines time differences. Sound quality is improved for the multiple speakers based on the respective relative delay for each of the multiple speakers. The trigger sound is generated by one of an electronic device, a mechanical device or user generated.

These and other features, aspects and advantages of the one or more embodiments will become understood with reference to the following description, appended claims and accompanying figures.

DETAILED DESCRIPTION

Figure 1:
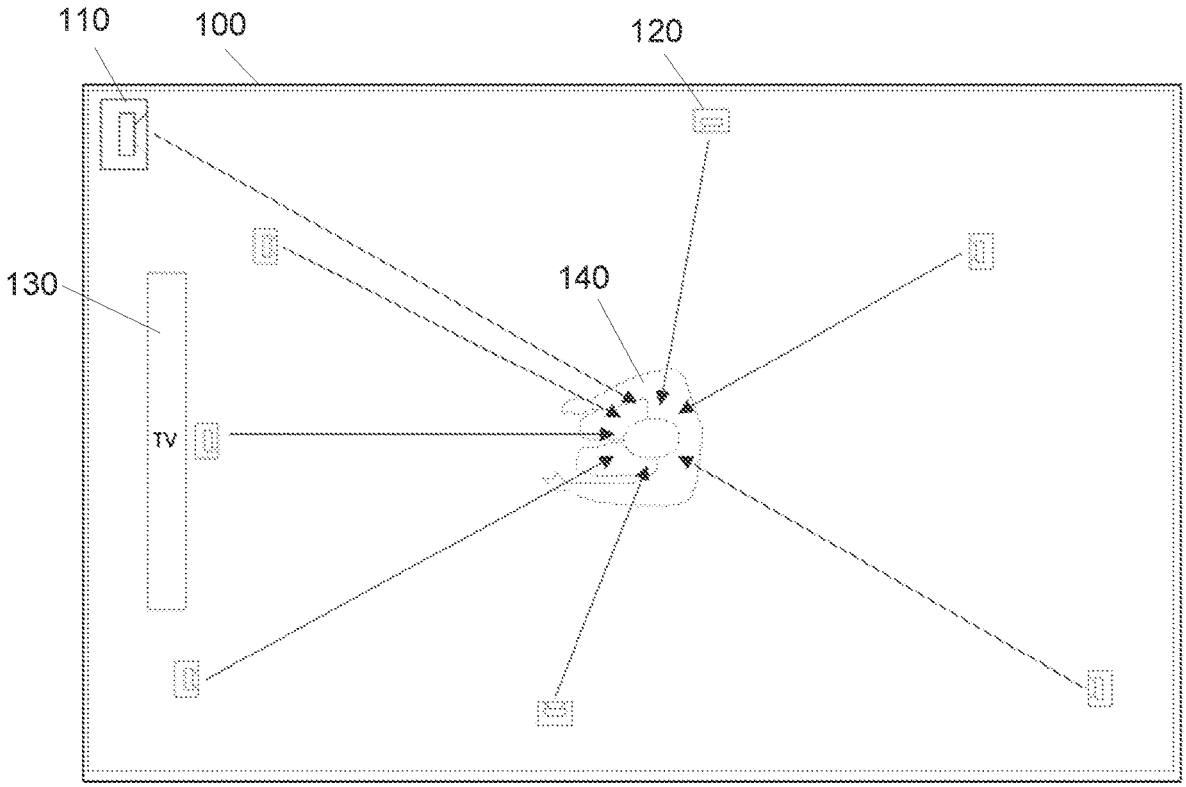
FIG. 1 illustrates an example home theater environment.

The following description is made for the purpose of illustrating the general principles of one or more embodiments and is not meant to limit the inventive concepts claimed herein. Further, particular features described herein can be used in combination with other described features in each of the various possible combinations and permutations. Unless otherwise specifically defined herein, all terms are to be given their broadest possible interpretation including meanings implied from the specification as well as meanings understood by those skilled in the art and/or as defined in dictionaries, treatises, etc.

One or more embodiments relate generally to sound quality for multiple speakers in a listening environment, and in particular, to automatically determining sound delays per speaker in a listening environment for improving sound quality. One embodiment provides a computer-implemented method that includes receiving a trigger sound from a primary listening location. The trigger sound being received at multiple speakers in a synchronous network at different times. The trigger sound is recognized at the multiple speakers. A respective relative delay is determined based on a time differential function that determines time differences. Sound quality for the multiple speakers is improved based on the respective relative delay for each of the multiple speakers.

For expository purposes, the terms "speaker," "speaker device," "speaker system," "loudspeaker," "loudspeaker device," and "loudspeaker system" may be used interchangeably in this specification.

For conventional home theater systems with multiple speakers and an audio/visual (AV) receiver, the user manually enters the physical distance from each speaker to the primary listening location. Some customers hire AV installers to equalize (EQ) their speakers. These installers usually use a microphone(s) to EQ the system. The microphone at the listen location can be used to set the correct delays accurately. Many times, the EQ of the system takes quite some time, and may have to restart several times due to ambient sounds (e.g., aircraft, automotive, animal, human, etc., sounds).

A sound bar can replace an AV receiver and individual speakers. Most sound bars have left, center and right speakers. Others may include side-firing and up-firing speakers for surround and height channels. Others may include separate surround speakers as well, that may include additional up-firing height speakers. Because the most important channels are all in one enclosure, time alignment is generally not performed on sound bar-based sound systems. Some sound bars allow the customer to manually adjust the delays of some of the speakers, but most customers do not.

A new class of speakers called "smart speakers" can be connected to a TV through various means. These speakers have built in microphones to facilitate their "smart functions." Some of these speakers use the microphone to EQ the speaker to the room. Distinguishable, one or more embodiments may be used to set the correct delays for all loudspeaker in a home theater system such that all sounds arrive at the primary listening location at the same time. The loudspeakers may be individual loudspeakers such as those in a traditional home theater system (e.g., left front speaker, center speaker, right front speaker, left side speaker, right side speaker, left rear speaker, right rear speaker, left front height speaker, right front height speaker, left rear height speaker, right rear height speaker, etc.). Some of these speakers may be integrated into a sound bar (e.g., front left speaker, center speaker, left side speaker, right side speaker, left front height speaker, right front height speaker) while the other speakers are individual speakers. Sometimes individual speakers are combined (e.g., left rear speaker and left rear height speaker, etc.).

In some embodiments, loudspeakers built-in to the TV may be used in in place of the sound bar and/or some of the individual speakers. Regardless of speaker system configuration one or more embodiments can insure time alignment of all sounds from all loudspeakers at the primary listening location. Therefore, the system may be used to properly set delays at the primary listening location on any combination of TV speakers, sound bars, and individual speakers.

One or more embodiments automatically calculates the correct delay of all loudspeakers in the system and, therefore, improves spatial quality of the sound system dramatically. Many "smart loudspeakers" have built in microphones which can be used to estimate the average response in the listening room or the average response in the central portion of the listening room using artificial intelligence (AI) or classical techniques. This information can be used to EQ the loudspeaker, which improves the sound quality of the speaker. However, these speakers have no way to determine their distance to the primary listening location. Therefore, spatial quality is not improved. Distinguishable, one or more embodiments improve spatial quality FIG. 1 illustrates an example home theater environment 100. The home theater environment 100 system includes loudspeakers 120 (center, front left and right, surround left and right, and rear left and right), subwoofer 110, and TV 130. The user listening position 140 is the target for receiving the sound signals from the home theater system in the environment 100. Some embodiments automatically set the time delays for all the loudspeakers 120 in the home theater system to improve the spatial quality. In one or more of the following described embodiments it is assumed that all the loudspeakers 120 have at least one microphone built into them and that all the loudspeakers 120 are connected to one-another through a network of some kind (e.g., hardwired or wireless) that is synchronous.

Figure 2A:
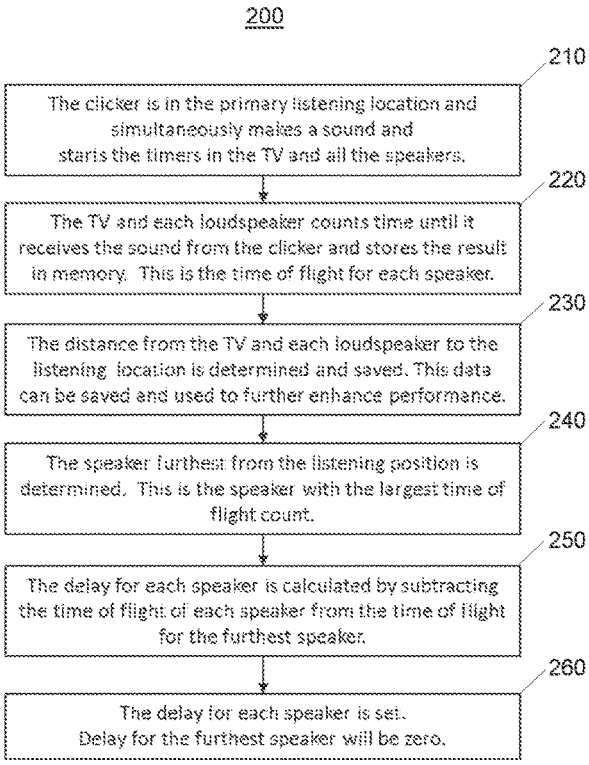
FIG. 2A illustrates a process for triggering a sound using a TV and sound generator connected with a synchronous network, and determining sound delays per speaker in a listening environment, according to some embodiments.

FIG. 2A illustrates a process 200 for triggering a sound using a TV and sound generator connected with a synchronous network, and determining sound delays per speaker in a listening environment (e.g., home theater environment 100, FIG. 1), according to some embodiments. A trigger sound is a sound that the loudspeakers in the synchronous network recognize. In some embodiments, in block 210 a device that makes the trigger sound is connected to the synchronous network that the loudspeakers are connected to. The trigger device may be a loudspeaker, a simple "clicker," a "slate" (clapboard or clapperboard: the device used at the start of filming a scene in a movie), a cell phone or any other device that can make a consistent and repeatable sound. The actual sound the device makes is not important as long as it makes a repeatable and consistent sound that the speakers can be trained to recognize. The TV is also connected to the synchronous network and has a built-in microphone. The trigger device is located at the primary listening location (e.g., the listening location of the position typically most used or fixed for the user(s)) and the trigger device simultaneously makes the trigger sound and sends a signal over the synchronous network that triggers each loudspeaker and the TV to start their respective timer. In block 220, the TV and each loudspeaker counts the time from the trigger signal until it receives the sound from the clicker (or trigger device) and stores the result in memory (the time of flight for each speaker).

In one or more embodiments, in block 230 the distance from the TV and each speaker to the listening location is determined and saved in memory. This distance data can optionally be saved and used to further enhance performance. The TV and each loudspeaker receive the trigger sound at a different time based on distance. The distance from the TV and each speaker to the primary listening location can be calculated by dividing the speed of sound by the timer count from each speaker. This additional information can be used to further optimize the system. In block 240, the correct delay may be calculated by subtracting the timer count for each speaker from the speaker that sensed the trigger sound last (i.e., the loudspeaker furthest from the primary listening location, which has the largest time of flight count). In block 250, the delay for each speaker is calculated by subtracting the time of flight of each speaker from the time of flight for the furthest speaker. In block 260, the delay for each speaker is set. In some embodiments, the delay for the furthest speaker may be set to zero. If the trigger device can make a trigger sound with sufficient bandwidth, the correct sound pressure level (SPL) of each speaker can be set. In some embodiments, instead of using timers, the respective delay may be determined using a time differential function (e.g., a generalized cross-correlation phase transform algorithm" (GCC-PHAT), cross-correlation function using Fourier transform algorithms, etc.) that determines time differences. A GCC-PHAT computes the time difference of arrival (TDOA) between two signals for a given segment in a complete signal. A computation of the TDOA is typically repeated on every segment between a pair of microphones. A time delay is estimated after a cross-correlation between two segments of signals in the frequency domain.

Figure 2B:
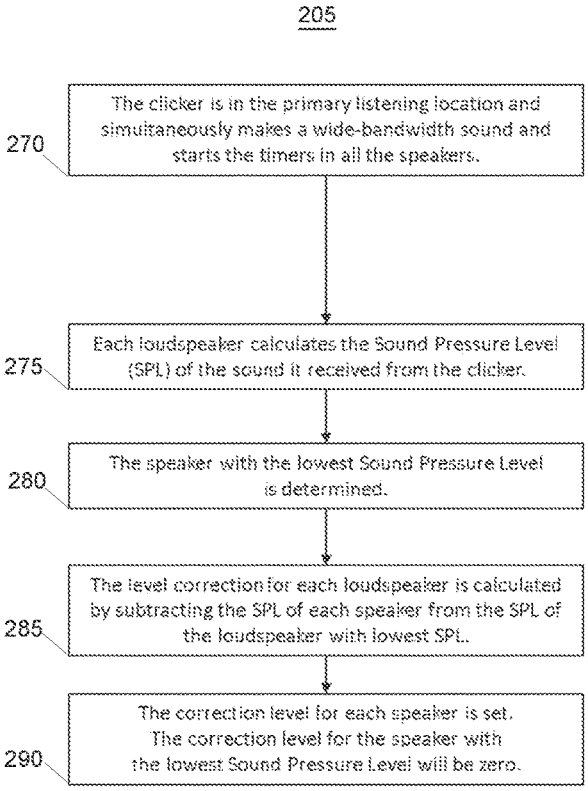
FIG. 2B illustrates a process for optional calculations in addition to the process shown in FIG. 2A, according to some embodiments.

FIG. 2B illustrates a process 205 for optional calculations in addition to the process 200 shown in FIG. 2A, according to some embodiments. In block 270, the trigger device or clicker is in the primary listening location and simultaneously makes a wide-bandwidth sound and starts the timers of all speakers. In block 275, each speaker calculates the SPL of the sound it received from the trigger device or clicker. In block 280, the speaker with the lowest SPL is determined from each of the SPL determined by each speaker. In block 285, the SPL correction for each speaker is calculated by subtracting the SPL of each speaker from the SPL of the speaker with the lowest SPL. In block 290, the correction SPL for each speaker is set. In some embodiments, the correction SPL for the speaker with the lowest SPL will be zero.

Figures 3A, 3B:
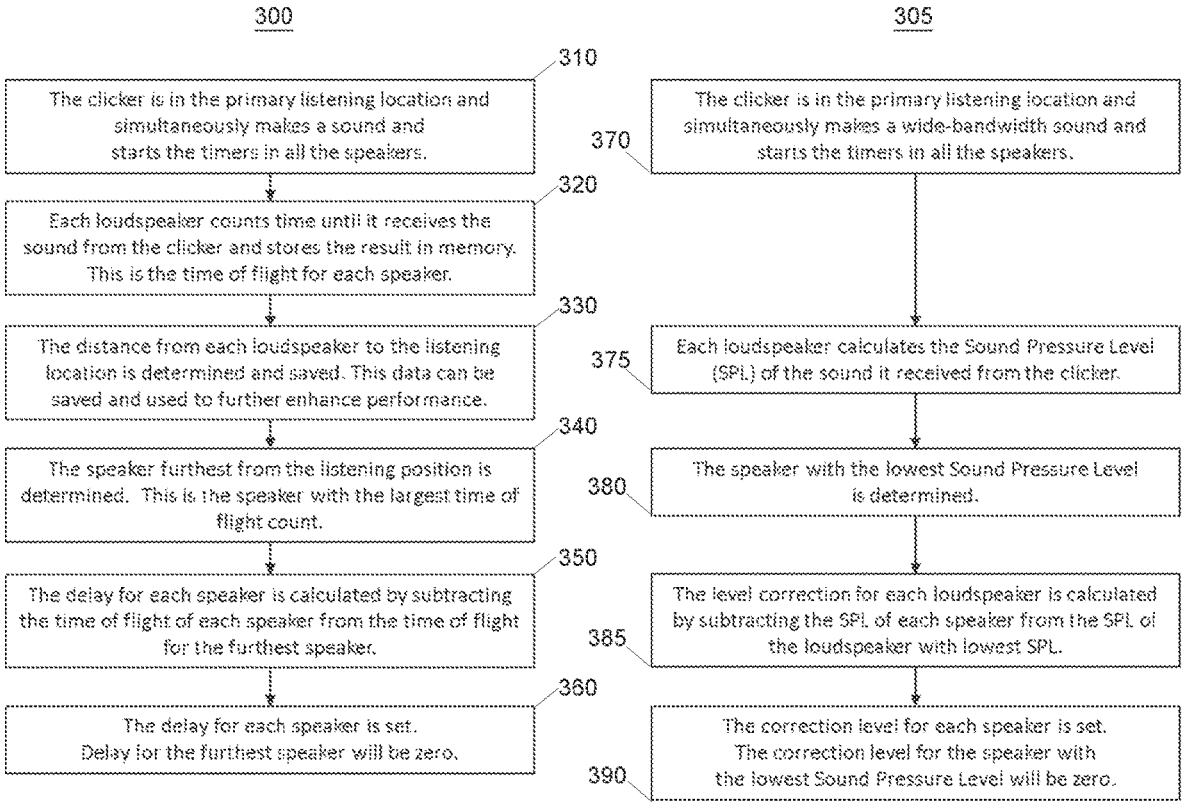
FIG. 3A illustrates a process for triggering a sound using a sound generator connected with a synchronous network, and determining sound delays per speaker in a listening environment, according to some embodiments.
FIG. 3B illustrates a process for optional calculations in addition to the process shown in FIG. 3A, according to some embodiments.

FIG. 3A illustrates a process 300 for triggering a sound using a sound generator (or clicker) connected with a synchronous network, and determining sound delays per speaker in a listening environment, according to some embodiments. In this embodiment a device that makes the trigger sound is connected to the synchronous network that the loudspeakers are connected to. In block 310, the trigger device is located at the primary listening location and the trigger device simultaneously makes the trigger sound and sends a signal over the synchronous network that each speaker should start their timer. In block 320, each speaker counts time until it receives the sound from the trigger device, and stores the result (time of flight for each speaker) in a memory device. Each speaker will receive the trigger sound at a different time. In block 330, the distance from each speaker to the listening location is determined and saved in memory. This distance data may be used at a later time to further enhance performance. In block 340, the speaker furthest from the listening position is determined (this is the speaker with the largest time of flight count). In block 350, the correct delay may be calculated by subtracting the timer count for each speaker from that of the speaker that sensed the trigger sound last (i.e., the speaker furthest from the primary listening location, which has the largest time of flight count). In block 360, the delay for each speaker is set. In some embodiments, the delay for the furthest speaker may be set to zero. If the trigger device can make a trigger sound with sufficient bandwidth, the correct sound pressure level (SPL) of each speaker can be set.

FIG. 3B illustrates a process 305 for optional calculations in addition to the process 300 shown in FIG. 3A, according to some embodiments. In block 370, the trigger device or clicker is in the primary listening location and simultaneously makes a wide-bandwidth sound and starts the timers of all speakers. In block 375, each speaker calculates the SPL of the sound it received from the trigger device or clicker. In block 380, the speaker with the lowest SPL is determined from each of the SPL determined by each speaker. In block 385, the SPL correction for each speaker is calculated by subtracting the SPL of each speaker from the SPL of the speaker with the lowest SPL. In block 390, the correction SPL for each speaker is set. In some embodiments, the correction SPL for the speaker with the lowest SPL will be zero.

Figures 4A, 4B:
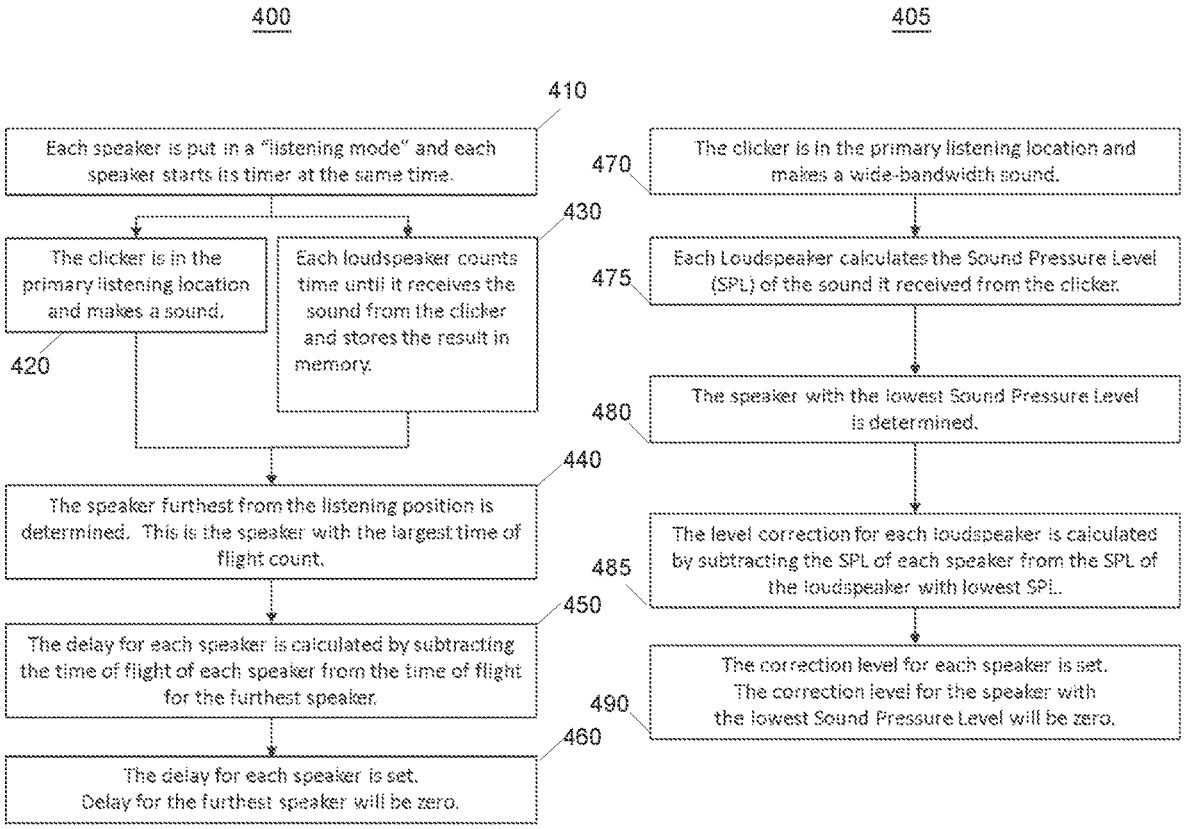
FIG. 4A illustrates a process for triggering a sound that is not connected with a synchronous network, and determining sound delays per speaker in a listening environment, according to some embodiments.
FIG. 4B illustrates a process for optional calculations in addition to the process shown in FIG. 4A, according to some embodiments.

FIG. 4A illustrates a process 400 for triggering a sound that is not connected with a synchronous network, and determining sound delays per speaker in a listening environment, according to some embodiments. In block 410, all the speakers in the system are put into a "listening mode" by the user. In some embodiments, a timer starts when the speakers are placed in the listening mode (the speakers are in a synchronized network). In the listening mode, the speakers are ready, the microphone at each speaker is turned on and is listening for a trigger sound. In block 420, at the trigger device is at the primary listening location and makes a trigger sound. In block 430, each speaker receives the trigger sound at a different time and counts the time until it receives the sound from the trigger device and stores the result in a memory device. The correct delay can be calculated by subtracting the timer count for each speaker from the speaker that sensed the trigger sound last (i.e., the loudspeaker furthest from the primary listening location). In block 440, the speaker furthest from the listening position is determined (this is the speaker with the largest time of flight count). In block 450, the correct delay may be calculated by subtracting the timer count (time of flight) for each speaker from that of the speaker that sensed the trigger sound last (i.e., the speaker furthest from the primary listening location, which has the largest time of flight count). In block 460, the delay for each speaker is set. In some embodiments, the delay for the furthest speaker may be set to zero. The distance from each speaker to the primary listening location is not known. But the most important information, the relative distance from each speaker to the primary listening location is accurately calculated and the correct delays can be set.

FIG. 4B illustrates a process 405 for optional calculations in addition to the process 400 shown in FIG. 4A, according to some embodiments. In block 470, the trigger device or clicker is in the primary listening location and simultaneously makes a wide-bandwidth sound. In block 475, each speaker calculates the SPL of the sound it received from the trigger device or clicker. In block 480, the speaker with the lowest SPL is determined from each of the SPL determined by each speaker. In block 485, the SPL correction for each speaker is calculated by subtracting the SPL of each speaker from the SPL of the speaker with the lowest SPL. In block 490, the correction SPL for each speaker is set. In some embodiments, the correction SPL for the speaker with the lowest SPL will be zero.

Figure 5:
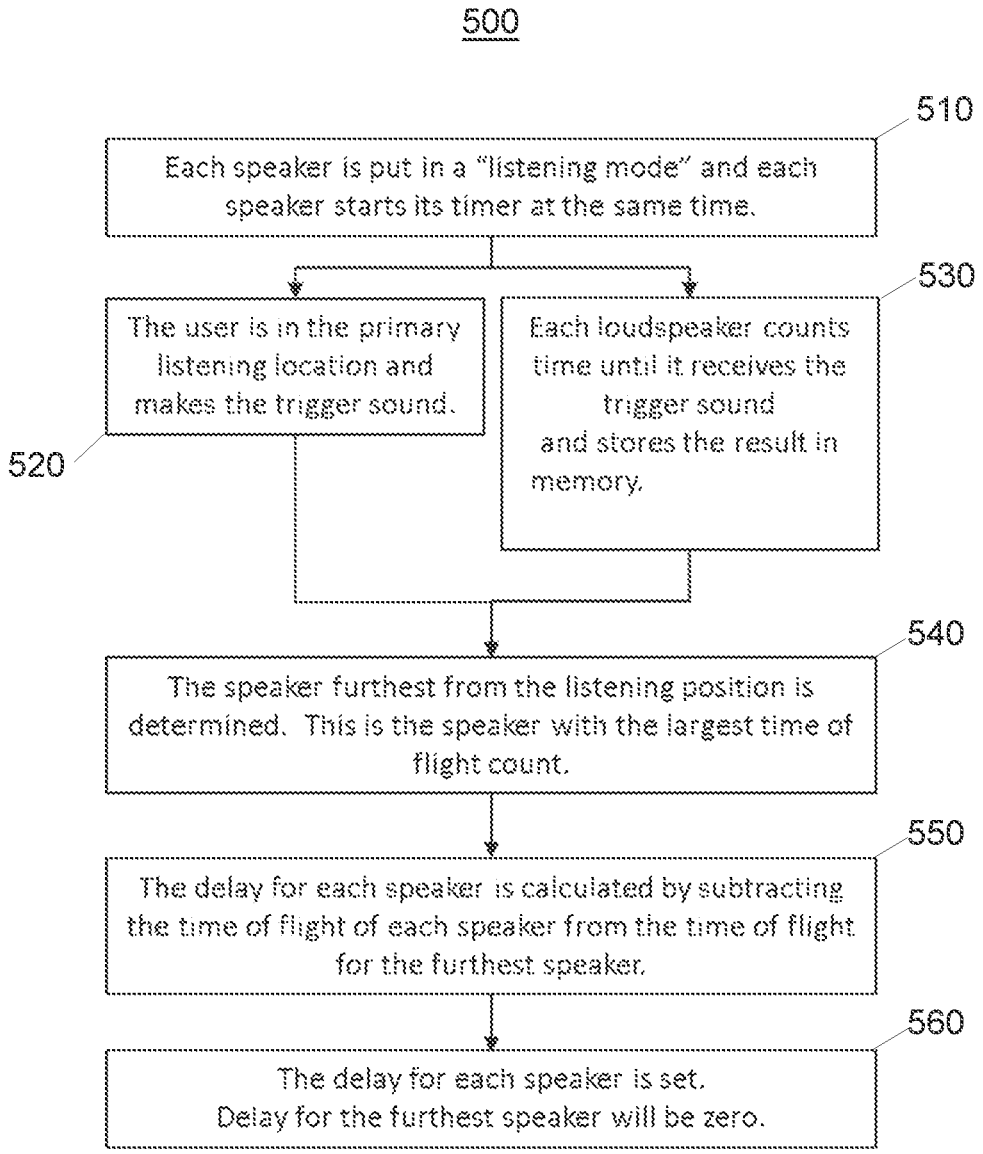
FIG. 5 illustrates a process for using a self-generated sound, and determining sound delays per speaker in a listening environment, according to some embodiments

FIG. 5 illustrates a process 500 for using a self-generated sound, and determining sound delays per speaker in a listening environment, according to some embodiments. In block 510, all the speakers in the system are put into a "listening mode" by the user. In some embodiments, a timer starts when the speakers are placed in the listening mode (the speakers are in a synchronized network). In the listening mode, the speakers are ready, the microphone at each speaker is turned on and is listening for a trigger sound. In block 520, the user is at the primary listening location and makes a trigger sound (e.g., the user utters a word, phrase, claps their hands, snaps their fingers, makes any other sound that the speakers can be trained to recognize, etc.). In block 530, each speaker receives the trigger sound at a different time and counts the time until it receives the trigger sound from the user, and stores the result in a memory device. The correct delay can be calculated by subtracting the timer count for each speaker from the speaker that sensed the trigger sound last (i.e., the loudspeaker furthest from the primary listening location). In block 540, the speaker furthest from the listening position is determined (this is the speaker with the largest time of flight count). In block 550, the correct delay may be calculated by subtracting the timer count (time of flight) for each speaker from that of the speaker that sensed the trigger sound last (i.e., the speaker furthest from the primary listening location, which has the largest time of flight count). In block 560, the delay for each speaker is set. In some embodiments, the delay for the furthest speaker may be set to zero. The distance from each speaker to the primary listening location is not known. But the most important information, the relative distance from each speaker to the primary listening location is accurately calculated and the correct delays can be set. In some embodiments, the distance from each speaker to the primary listening location is not known. But the most important information, the relative distance from each speaker to the primary listening location is accurately calculated and the correct delays can be set. If the trigger sound has sufficient bandwidth, it may be used to estimate the correct SPL settings for each speaker as well.

Figure 6:
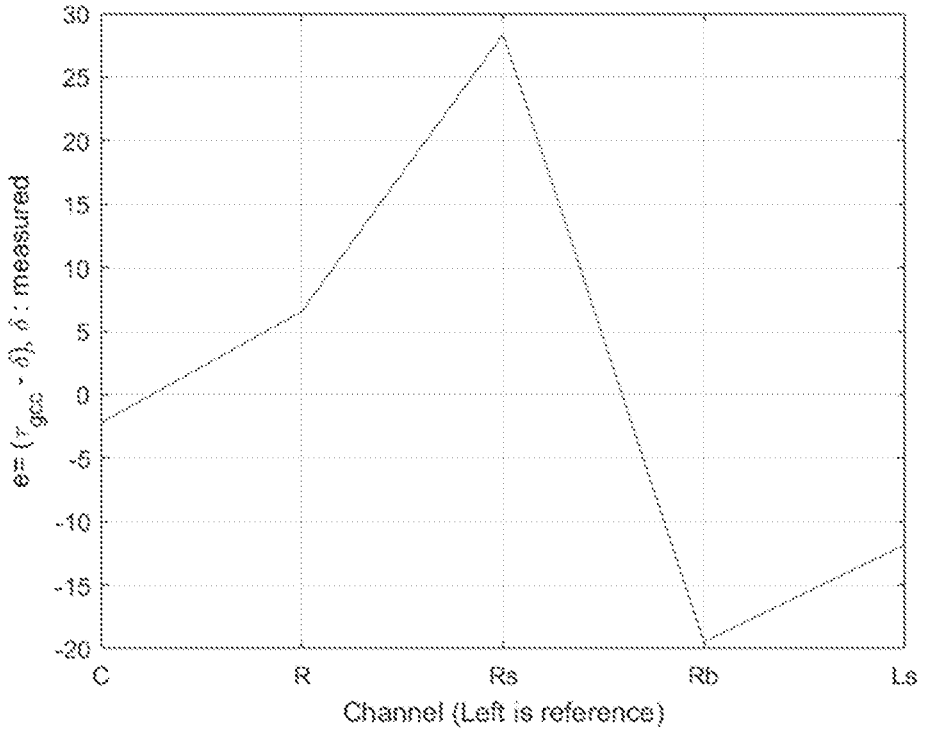
FIG. 6 illustrates a graph showing error in samples (with a 48 kHz sample rate) compared to actual delay of five speakers in a home theater system relative to the front left speaker, according to some embodiments.

FIG. 6 illustrates a graph 600 showing error in samples (with a 48 kHz sample rate) compared to actual delay of five speakers in a home theater system relative to the front left speaker, according to some embodiments. Graph 600 shows the relative-delay estimate of the center (C) and right (R) speakers are very good (less than 7 samples, 0.15 milliseconds, or 4 cm). The average relative delay error for the surround ($R_S$ and $L_S$) and back channels ($R_b$) is good (about 20 samples, or 0.4 milliseconds, or 10 cm).

In some embodiments, including more than one microphone in the speakers allows the system to infer more important data, which may be used to further optimize the system's performance. Including a microphone in the trigger device allows the system to infer more important data, which may be used to further optimize the systems performance. The delay of the audio system's subwoofer relative to the main speakers can also be set properly using the embodiments described herein. The following table shows the capabilities of one or more embodiments with various hardware configurations:

TABLE I

| Connected Synchronous Network | | | |
|---|---|---|---|
| Speakers | Trigger Device | TV (w/mic) | System Capabilities |
| Yes | No | No | Relative Delays |
| Yes | Yes | No | Relative Delays<br>Speaker to Listener Distances |
| Yes | Yes | Yes | Relative Delays<br>Speaker to Listener Distances<br>TV to Listener Distance |

Figure 7:
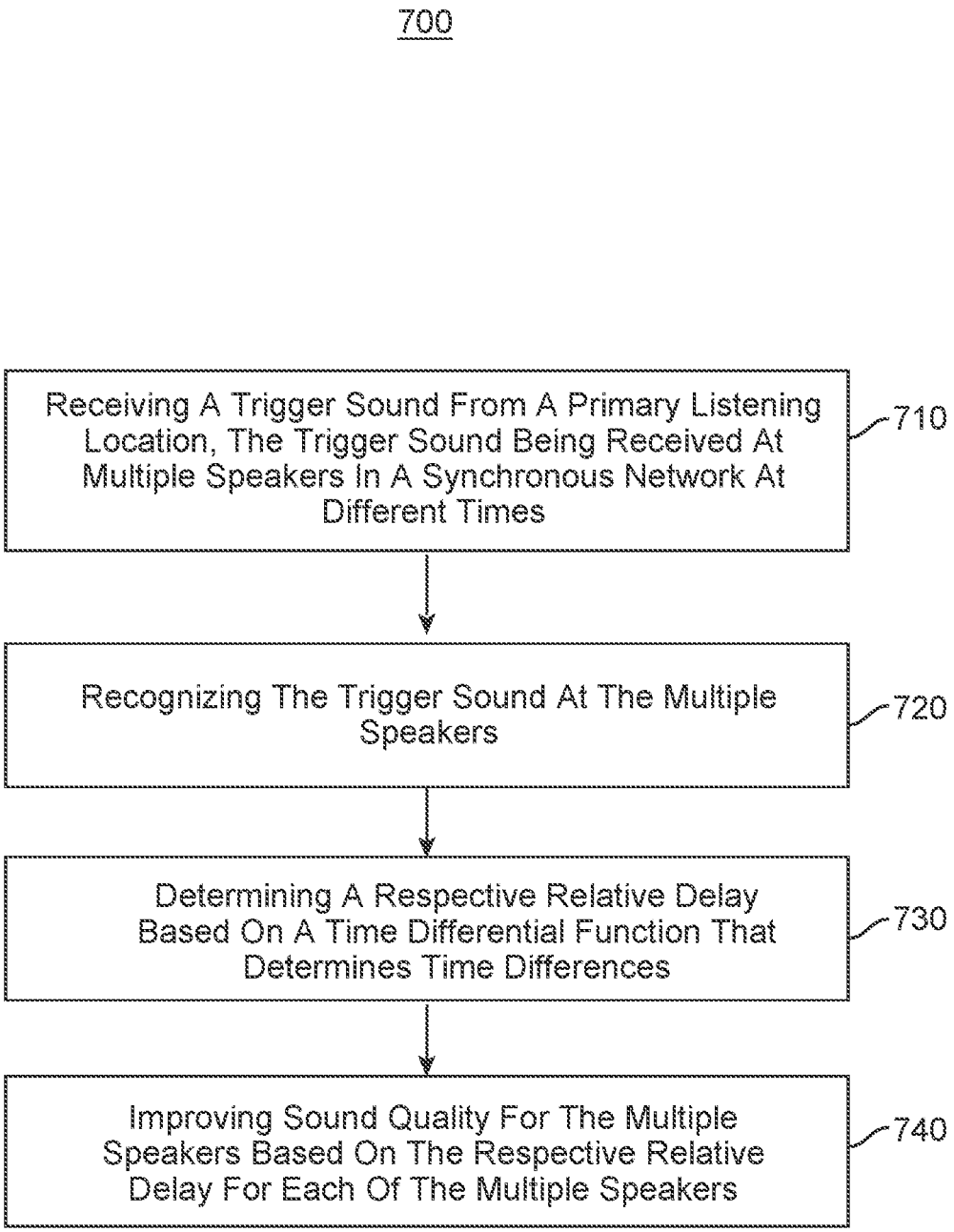
FIG. 7 illustrates a process for using sound to determine sound delays per speaker in a listening environment, according to some embodiments.

FIG. 7 illustrates a process 700 for using sound to determine sound delays per speaker in a listening environment, according to some embodiments. In block 710, process 700 provides. In block 710, process 700 receives a trigger sound from a primary listening location (e.g., listening location 140, FIG. 1). The trigger sound being received at multiple speakers (e.g., speakers 120, FIG. 1) in a synchronous network at different times. In block 720, process 700 provides recognizing the trigger sound at the multiple speakers. In block 730, process 700 provides determining a respective relative (time) delay based on a time differential function (e.g., GCC-PHAT, cross-correlation function using Fourier transform algorithms, etc.) that determines time differences. In block 740, process 700 provides improving sound quality for the multiple speakers based on the respective relative delay for each of the multiple speakers.

In some embodiments, process 700 provides the feature that the trigger sound is generated by one of an electronic device (e.g., a cell phone, an electronic clicker device, etc.), a mechanical device (e.g., a slate, a mechanical clicker device, etc.) or user generated (e.g., clapping of hands, etc.).

In one or more embodiments, process 700 further provides the feature that a TV device (e.g., TV 130, etc.) in the synchronous network additionally determines a delay based on receiving the trigger sound.

In some embodiments, process 700 still further provides storing the respective delay for each of the multiple speakers in a respective memory device.

In one or more embodiments, process 700 additionally provides: determining a respective SPL based on the trigger sound by each of the multiple speakers; determining a particular speaker of the multiple speakers that has a lowest SPL; and correcting a respective SPL for each of the multiple speakers except that of the particular speaker that has the lowest SPL.

In some embodiments, process 700 yet further provides the feature that the determined respective relative delay is based on determining respective distance from the primary listening location to each respective speaker of the multiple speakers.

In one or more embodiments, process 700 additionally provides initiating a listening mode for each of the multiple speakers, and the time differential function is one of a generalized cross-correlation phase transform function.

In some embodiments, in lieu of individual timers in each of the multiple speakers (and potentially the TV) or a time differential function, the trigger device may initiate the sampling of a sound received by each of the microphones.

The data from each of the multiple speakers (and potentially the TV) may then be transmitted to a central location where Fourier Methods may be used to calculate the absolute and relative time delays for each of the multiple speakers (and potentially the TV). In one example embodiment, the results shown in FIG. 6 uses a GCC-PHAT process or algorithm.

Some embodiments use microphones built into the individual loudspeakers and use sound creation/generation at the listening location to properly set the time delay of all the speakers. One or more embodiments create a wide-bandwidth sound at the listening location and calculate the SPL at each speaker, and use this information to set the correct level of each speaker. These features of some embodiments are the opposite of the conventional approach: creating sounds from the speakers and placing a microphone at the listening location. It should be noted that the approaches of one or more embodiments require only a single measurement for all speakers, regardless of the number of speakers in a system, while the conventional method requires a unique measurement for each speaker.

Embodiments have been described with reference to flowchart illustrations and/or block diagrams of methods, apparatus (systems) and computer program products. Each block of such illustrations/diagrams, or combinations thereof, can be implemented by computer program instructions. The computer program instructions when provided to a processor produce a machine, such that the instructions, which execute via the processor create means for implementing the functions/operations specified in the flowchart and/or block diagram. Each block in the flowchart/block diagrams may represent a hardware and/or software module or logic. In alternative implementations, the functions noted in the blocks may occur out of the order noted in the figures, concurrently, etc.

The terms "computer program medium," "computer usable medium," "computer readable medium", and "computer program product," are used to generally refer to media such as main memory, secondary memory, removable storage drive, a hard disk installed in hard disk drive, and signals. These computer program products are means for providing software to the computer system. The computer readable medium allows the computer system to read data, instructions, messages or message packets, and other computer readable information from the computer readable medium. The computer readable medium, for example, may include non-volatile memory, such as a floppy disk, ROM, flash memory, disk drive memory, a CD-ROM, and other permanent storage. It is useful, for example, for transporting information, such as data and computer instructions, between computer systems. Computer program instructions may be stored in a computer readable medium that can direct a computer, other programmable data processing apparatus, or other devices to function in a particular manner, such that the instructions stored in the computer readable medium produce an article of manufacture including instructions which implement the function/act specified in the flowchart and/or block diagram block or blocks.

As will be appreciated by one skilled in the art, aspects of the embodiments may be embodied as a system, method or computer program product. Accordingly, aspects of the embodiments may take the form of an entirely hardware embodiment, an entirely software embodiment (including firmware, resident software, micro-code, etc.) or an embodiment combining software and hardware aspects that may all generally be referred to herein as a "circuit," "module" or "system." Furthermore, aspects of the embodiments may take the form of a computer program product embodied in one or more computer readable medium(s) having computer readable program code embodied thereon.

Any combination of one or more computer readable medium(s) may be utilized. The computer readable medium may be a computer readable storage medium. A computer readable storage medium may be, for example, but not limited to, an electronic, magnetic, optical, electromagnetic, infrared, or semiconductor system, apparatus, or device, or any suitable combination of the foregoing. More specific examples (a non-exhaustive list) of the computer readable storage medium would include the following: an electrical connection having one or more wires, a portable computer diskette, a hard disk, a random access memory (RAM), a read-only memory (ROM), an erasable programmable read-only memory (EPROM or Flash memory), an optical fiber, a portable compact disc read-only memory (CD-ROM), an optical storage device, a magnetic storage device, or any suitable combination of the foregoing. In the context of this document, a computer readable storage medium may be any tangible medium that can contain or store a program for use by or in connection with an instruction execution system, apparatus, or device.

Computer program code for carrying out operations for aspects of one or more embodiments may be written in any combination of one or more programming languages, including an object oriented programming language such as Java, Smalltalk, C++ or the like and conventional procedural programming languages, such as the "C" programming language or similar programming languages. The program code may execute entirely on the user's computer, partly on the user's computer, as a stand-alone software package, partly on the user's computer and partly on a remote computer or entirely on the remote computer or server. In the latter scenario, the remote computer may be connected to the user's computer through any type of network, including a local area network (LAN) or a wide area network (WAN), or the connection may be made to an external computer (for example, through the Internet using an Internet Service Provider).

Aspects of one or more embodiments are described above with reference to flowchart illustrations and/or block diagrams of methods, apparatus (systems) and computer program products. It will be understood that each block of the flowchart illustrations and/or block diagrams, and combinations of blocks in the flowchart illustrations and/or block diagrams, can be implemented by computer program instructions. These computer program instructions may be provided to a special purpose computer, or other programmable data processing apparatus to produce a machine, such that the instructions, which execute via the processor of the computer or other programmable data processing apparatus, create means for implementing the functions/acts specified in the flowchart and/or block diagram block or blocks.

These computer program instructions may also be stored in a computer readable medium that can direct a computer, other programmable data processing apparatus, or other devices to function in a particular manner, such that the instructions stored in the computer readable medium produce an article of manufacture including instructions which implement the function/act specified in the flowchart and/or block diagram block or blocks.

The computer program instructions may also be loaded onto a computer, other programmable data processing apparatus, or other devices to cause a series of operational steps to be performed on the computer, other programmable apparatus or other devices to produce a computer implemented process such that the instructions which execute on the computer or other programmable apparatus provide processes for implementing the functions/acts specified in the flowchart and/or block diagram block or blocks.

The flowchart and block diagrams in the Figures illustrate the architecture, functionality, and operation of possible implementations of systems, methods, and computer program products according to various embodiments. In this regard, each block in the flowchart or block diagrams may represent a module, segment, or portion of instructions, which comprises one or more executable instructions for implementing the specified logical function(s). In some alternative implementations, the functions noted in the block may occur out of the order noted in the figures. For example, two blocks shown in succession may, in fact, be executed substantially concurrently, or the blocks may sometimes be executed in the reverse order, depending upon the functionality involved. It will also be noted that each block of the block diagrams and/or flowchart illustration, and combinations of blocks in the block diagrams and/or flowchart illustration, can be implemented by special purpose hardware-based systems that perform the specified functions or acts or carry out combinations of special purpose hardware and computer instructions.

References in the claims to an element in the singular is not intended to mean "one and only" unless explicitly so stated, but rather "one or more." All structural and functional equivalents to the elements of the above-described exemplary embodiment that are currently known or later come to be known to those of ordinary skill in the art are intended to be encompassed by the present claims. No claim element herein is to be construed under the provisions of 35 U.S.C. section 112, sixth paragraph, unless the element is expressly recited using the phrase "means for" or "step for."

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

The corresponding structures, materials, acts, and equivalents of all means or step plus function elements in the claims below are intended to include any structure, material, or act for performing the function in combination with other claimed elements as specifically claimed. The description of the embodiments has been presented for purposes of illustration and description, but is not intended to be exhaustive or limited to the embodiments in the form disclosed. Many modifications and variations will be apparent to those of ordinary skill in the art without departing from the scope and spirit of the invention.

Though the embodiments have been described with reference to certain versions thereof; however, other versions are possible. Therefore, the spirit and scope of the appended claims should not be limited to the description of the preferred versions contained herein.

What is claimed is:

1. A computer-implemented method comprising:

receiving a trigger sound from a primary listening location, the trigger sound being received at multiple speakers in a synchronous network at different times;

recognizing the trigger sound at the multiple speakers;

determining a respective relative delay based on a time differential function that determines time differences; and improving sound quality for the multiple speakers based on the respective relative delay for each of the multiple speakers.

2. The computer-implemented method of claim 1, wherein the trigger sound is generated by one of an electronic device, a mechanical device or user generated.

3. The computer-implemented method of claim 1, wherein a television device in the synchronous network additionally determines a delay based on receiving the trigger sound.

4. The computer-implemented method of claim 1, further comprising:

storing the respective delay for each of the multiple speakers in a respective memory device.

5. The computer-implemented method of claim 1, further comprising:

determining a respective sound pressure level (SPL) based on the trigger sound by each of the multiple speakers;

determining a particular speaker of the multiple speakers that has a lowest SPL; and correcting a respective SPL for each of the multiple speakers except that of the particular speaker that has the lowest SPL.

6. The computer-implemented method of claim 1, wherein the determined respective relative delay is based on determining respective distance from the primary listening location to each respective speaker of the multiple speakers.

7. The computer-implemented method of claim 1, further comprising:

initiating a listening mode for each of the multiple speakers, wherein the time differential function is one of a generalized cross-correlation phase transform function.

8. A non-transitory processor-readable medium that includes a program that when executed by a processor performs determining sound delays per speaker in a listening environment, comprising:

receiving, by a respective processor coupled to at least one respective microphone, a trigger sound from a primary listening location, the trigger sound being received at multiple speakers in a synchronous network at different times;

recognizing, by each of the respective processors, the trigger sound at the multiple speakers;

determining, by each of the respective processors, a respective relative delay based on a time differential function that determines time differences; and improving, by each of the respective processors, respective sound quality for the multiple speakers based on the respective relative delay for each of the multiple speakers.

9. The non-transitory processor-readable medium of claim 8, wherein the trigger sound is generated by one of an electronic device, a mechanical device or user generated.

10. The non-transitory processor-readable medium of claim 8, wherein a television device in the synchronous network additionally determines a delay based on receiving the trigger sound.

11. The non-transitory processor-readable medium of claim 8, further comprising:

storing, by each of the respective processors, the respective delay in a respective memory device.

12. The non-transitory processor-readable medium of claim 8, further comprising:

determining, by each of the respective processors, sound pressure level (SPL) based on the trigger sound for its respective speaker of the multiple speakers;

determining, by each of the respective processors, a particular speaker of the multiple speakers that has a lowest SPL; and correcting, by each of the respective processors, a respective SPL for each speaker of the multiple speakers except that of the particular speaker that has the lowest SPL.

13. The non-transitory processor-readable medium of claim 8, wherein the determined respective relative delay is based on determining respective distance from the primary listening location to each respective speaker of the multiple speakers.

14. The non-transitory processor-readable medium of claim 8, further comprising:

initiating, by each of the respective processors, a listening mode for each respective speaker of the multiple speakers, wherein the time differential function is one of a generalized cross-correlation phase transform function.

15. An apparatus comprising:

a memory storing instructions; and at least one processor executes the instructions including a process configured to:

receive a trigger sound from a primary listening location, the trigger sound being received at multiple speakers in a synchronous network at different times;

recognize the trigger sound at the multiple speakers;

determine a respective relative delay based on a time differential function that determines time differences; and improve sound quality for the multiple speakers based on the respective relative delay for each of the multiple speakers, wherein the trigger sound is generated by one of an electronic device, a mechanical device or user generated.

16. The apparatus of claim 15, wherein a television device in the synchronous network additionally determines a delay based on receiving the trigger sound.

17. The apparatus of claim 15, wherein the process further configured to:

store the respective delay for each of the multiple speakers in a respective memory device.

18. The apparatus of claim 15, wherein the process further configured to:

determine a respective sound pressure level (SPL) based on the trigger sound by each of the multiple speakers;

determine a particular speaker of the multiple speakers that has a lowest SPL; and correct a respective SPL for each of the multiple speakers except that of the particular speaker that has the lowest SPL.

19. The apparatus of claim 15, wherein the determined respective relative delay is based on determining respective distance from the primary listening location to each respective speaker of the multiple speakers.

20. The apparatus of claim 15, wherein the process is further configured to:

initiate a listening mode for each of the multiple speakers, wherein the time differential function is one of a generalized cross-correlation phase transform function.

* * * * *